United States Patent [19]

Sprekeler

[11] 4,286,812

[45] Sep. 1, 1981

[54] SECURITY SCREEN DOOR LOCK

[75] Inventor: Otto G. G. Sprekeler, Tarragindi, Australia

[73] Assignee: Whitco Pty. Ltd., Sherwood, Australia

[21] Appl. No.: 86,311

[22] Filed: Oct. 19, 1979

[30] Foreign Application Priority Data

Oct. 16, 1979 [AU] Australia ..... 51837/79

[51] Int. Cl.[3] ..... E05C 1/16

[52] U.S. Cl. ..... 292/245; 292/173

[58] Field of Search ..... 292/150, 153, 173, 245

[56] References Cited

U.S. PATENT DOCUMENTS

| | | | |
|---|---|---|---|
| 6,396 | 2/1831 | Foster | 292/150 X |
| 2,209,574 | 7/1940 | Marsh | 292/173 |
| 3,011,817 | 12/1961 | Eads | 292/150 X |
| 3,209,564 | 10/1965 | Pelcin | 292/173 X |
| 3,586,361 | 6/1971 | Ohno | 292/153 X |

*Primary Examiner*—Richard E. Moore

*Attorney, Agent, or Firm*—Schwartz, Jeffery, Schwaab, Mack, Blumenthal & Koch

[57] ABSTRACT

A mortise-type deadlock for hingedly-mounted doors and windows where a locking block engages the lock tongue in the extended position. A pivotally-mounted stop lever on the locking block engages an abutment in the lock body to prevent the locking block being shaken free of the lock tongue. The lock tongue may be reversible and may be removed from the lock body by operating a stop member operable from the exterior of the lock body.

8 Claims, 3 Drawing Figures

SECURITY SCREEN DOOR LOCK

BACKGROUND OF THE INVENTION (1) Field of the Invention

This invention relates to a lock for security screen doors and is suitable for other doors or windows which are hingedly mounted.

(2) Description of the Prior Art

Over the years many different types of locks have been proposed and adopted. One common type is the so-called "mortise" lock which is suitable for hinged doors or windows.

To provide added security, deadlocking arrangements have been incorporated into these locks in an attempt to prevent the locks being picked or forced. While these deadlocking arrangements have been successful in certain areas, a problem has been found that these deadlocking arrangements can be circumvented by shaking the door or window to cause the lock tongue to be freed.

BRIEF SUMMARY OF THE INVENTION

It is an object of the present invention to provide a lock which cannot be released by shaking the door or window in which it is mounted.

It is a preferred object to provide a deadlock where the locking block which engages the normally extending lock tongue has a stop means operable to restrain the locking block in an engagement position.

It is a further preferred object to provide a mortise-type lock which has a reversible lock tongue, which can be removed from the lock body without the need to open the latter.

Other preferred objects will become apparent from the following description.

In the broad aspect, the present invention resides in a lock including:

a body;

a lock tongue normally extending from the body;

a locking block slidably movable in the body between a first position free of the lock tongue and a second position preventing retraction of the lock tongue;

an abutment in the body; and a stop lever movably mounted on the locking block and adapted to engage the abutment when the locking body is in the second position to restrain the locking body in the second position.

Preferably the stop lever is pivotally mounted on the locking block, and a spring means urges the stop lever into engagement with the abutment.

Preferably the lock is provided with a lock cylinder having a laterally extending cam adapted to move the locking block between the first position and the second position and to urge the stop lever out of engagement with the abutment against the spring means. Preferably an abutment face on the abutment is engaged by a complementary face on the stop lever.

Preferably there is a lateral bore through the locking block, and a pair of spaced apertures in the body adjacent the locking block, wherein the spring means includes:

a ball mounted in the lateral bore adapted to be seated in a respective one on the spaced apertures when the locking block is in the first position or in the second position.

Preferably the lock includes a slot in one side of the lock tongue adapted to be engaged by the locking block in the second position; a pin extending laterally from the lock tongue; a shaft rotatably mounted in the body; a handle operatively connected to the shaft and a lever mounted on the shaft in engagement with the pin and adapted to retract the lock tongue into the body on rotational movement of the handle. Preferably the lock tongue has an opposed pair of said pins, the lock tongue being reversible in the body.

Preferably a stop member mounted in the body and movable between a first position to retain the lever in engagement with the pin and a second position to free the lever from the pin to enable the lock tongue to be removed from the body.

BRIEF DESCRIPTION OF SEVERAL VIEWS OF THE DRAWING

To enable the invention to be fully understood, a preferred embodiment will now be described with respect to the accompanying drawings, in which.

DETAILED DESCRIPTION OF THE PREFERRED EMBODIMENT

Figure 1:
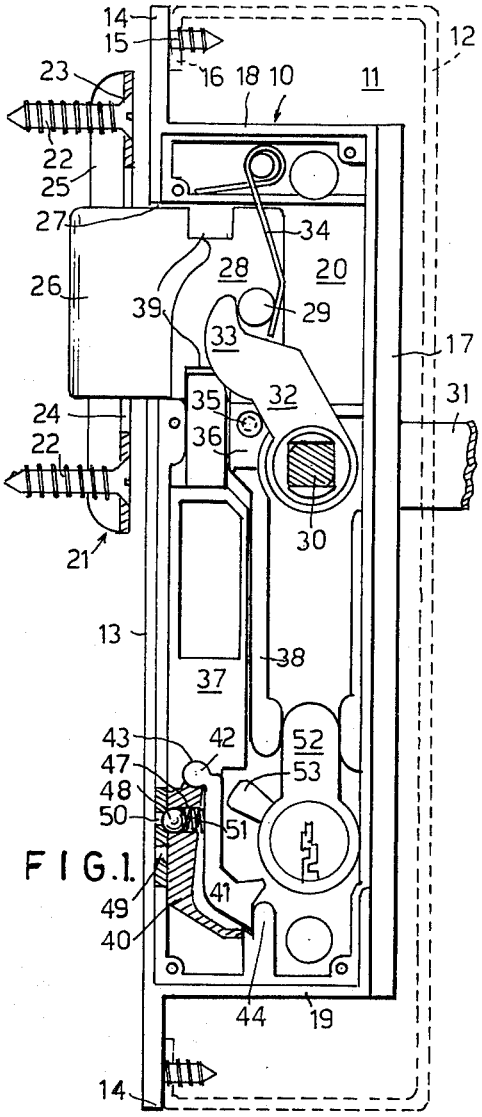
FIG. 1 is a sectional side view of the lock in the locking position with both the locking block and stop lever engaged.

The lock has a body 10 adapted to be fitted in a suitably dimensioned aperture 11 in a security screen door frame 12. The body 10 has a front plate 13 provided with a pair of extension pieces 14 having holes therethrough (not shown) to receive screws 15 to secure the body to flanges 16 on the frame 12. The body 10 has a back plate 17, a top plate 18, bottom plate 19, a fixed side 20 and a removable cover side (not shown).

A striker plate 21 is secured to the door architrave (not shown) by a pair of screws 22 passing through suitable holes 23. The striker plate 21 has a central aperture 24, and a side flange 25 to locate the striker plate laterally on the architrave.

A mortise-type lock tongue 26 is slidably mounted in the body 10 and normally extends through an aperture 27 on the front plate 13 which is aligned with the aperture 24 in the striker plate 21. The rearward portion 28 of the tongue 26 is of reduced thickness and has a pair of opposed pins 29 extending laterally therefrom.

A shaft 30 is rotatably mounted in the body 10 on the fixed side plate 20 and the removable cover plate and has a handle 31 secured to each end thereof. A lever 32 is mounted on the shaft 30 and has a hook 33 engaging one of the pins 29 on the lock tongue 26. As the handles 31 are depressed, the shaft 30 is rotated in a clockwise direction to cause the lever 32 to retract the lock tongue 26 into the body 10 against the torsion spring 34 (with its head open to the exterior of the body 10).

A screw 35 is threadably mounted in block 36 in the fixed side plate 20 and extends into the body and engages the side face of the lever 32 to retain the hook 33 in engagement with the pin 29. To enable the lock tongue 26 to be withdrawn from the body 10 via the aperture 27, the screw 35 may be rotated to withdraw the free end of the screw 35 into the block 36. The hook 33 falls free of the pin 29 and the lock tongue 26 may be withdrawn. To convert the lock from e.g. right-hand hung to left-hand hung, the lock tongue 26 is inverted and replaced in the body 10. The handle 31 is depressed to cause the hooks 33 to engage the second of the pins 29 and the screw 35 is caused to extend from the block 36 to retain the hook 33 in position.

A locking block 37 is slidably mounted on the body 10 rearwardly of the front plate and is guided by block 36 or guide flange 38. The locking block 37 is movable between a first position free of the lock tongue 26 (e.g. as in FIG. 3) and a second position (e.g. as in FIGS. 1 and 2) where the locking block 37 is engaged in one of a pair of opposed slots 39 in the sides of the lock tongue 26 when the latter is in the extended position. The lower portion 40 of the locking block 37 is of reduced width. A stop lever 41 has a ball 42 pivotally mounted in a socket integral in the lower portion 40. The stop lever 41 is pivotally movable between an extended position shown in FIG. 1 and a retracted position (lying closely adjacent to the lower portion 40) shown in FIGS. 2 and 3.

An abutment 44 is formed on the bottom plate 19 and fixed side plate 20 and extends into the body 10. An abutment face 45 is formed at an angle to the axis of movement of the locking block 37 and is engageable by a complementary surface 46 on the stop lever 41 when the latter is in the extended position (see FIG. 1).

Figure 2:
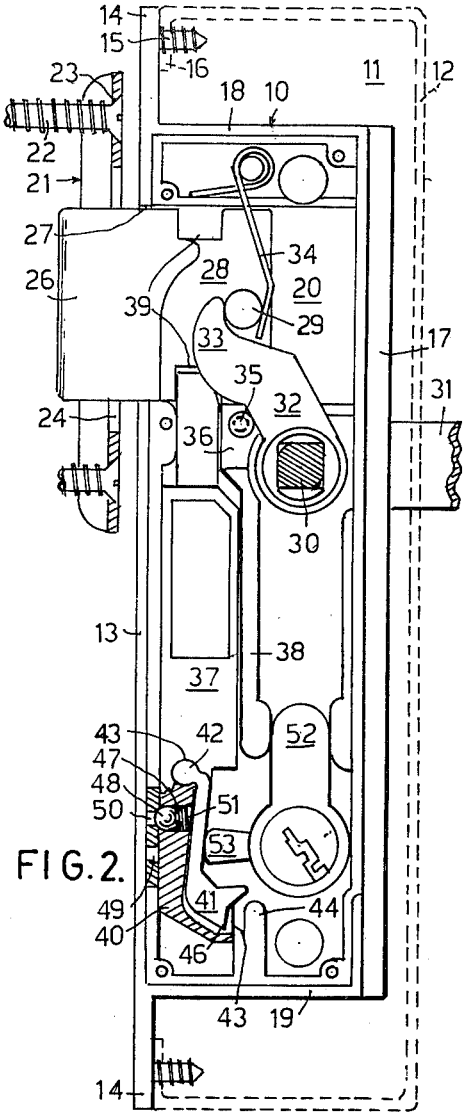
FIG. 2 shows the lock of FIG. 1 with the locking block engaged and the stop lever released.

A bore 47 is formed laterally through the lower portion 40 and a ball 48 is mounted in the bore 47 and is adapted to be seated in a lower hole 49 in the front plate 13 when the locking block 37 is in the first position (see FIG. 3) and in an upper hole 50 when the locking block 37 is in the second position (see FIGS. 1 and 2). A compression spring 51 is fitted in the bore 47 and is interposed between the ball 48 and the stop lever 41 to urge the ball 48 into sealing engagement in either hole 49 or 50 and to urge the stop lever 41 to the extended position.

A lock cylinder 52 is mounted in the body 10 (and extends through the fixed side plate 20 and removable cover plate) and has a cam 53 which is movable between the three positions shown in the FIGS.

The operation of the lock will now be described.

As shown in FIG. 1, the locking block 37 is in its second position and is engaged in one of the slots 39 to retain the lock tongue 26 in the extended position in engagement with the aperture 24 in the striker plate 21. The ball 48 is seated in the upper hole 50 and the stop lever 41 is in the extended position with its complementary face 46 engaged with the abutment face 45 to prevent the locking block 37 being shaken free of the slot 39. Cam 53 is in its upper position.

Referring to FIG. 2, the lock cylinder 52 is operated to move the cam 53 to its intermediate position. The cam 53 engages the stop lever 41 and urges it to its retracted position adjacent the lower portion 40 and free of the abutment 45. The locking block 37 is not moved and the ball 48 remains seated in upper hole 50.

Figure 3:
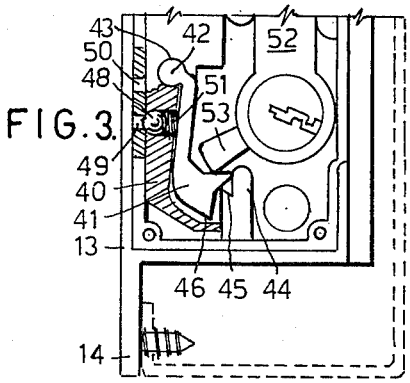
FIG. 3 shows a portion of the lock of FIG. 1 with both the locking block and stop lever released.

To release the locking block 37 from the slot 39 (and thereby allow lock tongue 26 to be moved to its retracted position by handles 31), the lock cylinder 52 is further operated to move the cam 53 to its lower position (see FIG. 3). The locking block 37 is pulled downwardly until the ball 48 is seated in the lower hole 49. The lock can now be operated in the same manner as an ordinary mortise-type lock by the handles 31.

To deadlock the lock tongue 26, the operation is reversed.

As the abutment face 45 is angled to the axis of movement of the locking block 37, it resists any likelihood of the stop lever 41 accidentally being released from the abutment 44 should the door frame 12 be shaken. In addition, the abutment face 45 resists any downward movement of the locking block 37 at the same time.

In a modified form of the lock, the stop lever 41 may be slidably mounted on the locking block 37 to extend laterally therefrom and have an upwardly inclined cam face engageable by the cam 53 to free the stop lever 41 from the abutment 44 before the locking block 37 is released from the slot 39. While the lock has been described as a mortise-type lock, the described and illustrated embodiment may be used on other types of locks which have sliding tongues or bolts which extend from, and are retracted into, the lock body.

Various other changes and modifications may be made to the embodiments described without departing from the scope of the present invention.

I claim:

1. A lock including:

a body;

a lock tongue normally extending from the body, said tongue being provided with means projecting from each side thereof to adapt said tongue to reversibility for use with both left and right hand opening doors;

means for retaining said tongue in its selected, reversible position;

a locking block slidably movable in the body between a first position free of the lock tongue and a second position preventing retraction of the lock tongue;

an abutment in the body; and a stop lever movably mounted on the locking block and adapted to engage the abutment when the locking body is in the second position to restrain the locking body in the second position.

2. A lock as claimed in claim 1 wherein said stop lever is pivotally mounted on the locking block, and further including spring means urging the stop lever into engagement with the abutment.

3. A door lock as claimed in claim 2 further including a lock cylinder having a laterally extending cam adapted to move the locking block between said first and second positions and to urge the stop lever out of engagement with the abutment against the spring means.

4. A lock as claimed in claim 3, further including an abutment face on the abutment formed at an angle to the axis of movement of the locking block, and a complementary face on the stop lever adapted to engage the abutment face.

5. A lock as claimed in claims 2, 3 or 4, further including a lateral bore through the locking block, and a pair of spaced apertures in the body adjacent the locking block, and wherein said spring means engages a ball mounted in the lateral bore adapted to be seated in a respective one of the spaced apertures when the locking block is in its first or second positions.

6. A lock as claimed in claim 1, further including a slot in one side of the lock tongue adapted to be engaged by the locking block when in its second position, said projecting means including a pin extending laterally from the lock tongue, a shaft rotatably mounted in the body a handle operatively connected to the shaft, and a lever mounted on the shaft in engagement with the pin and adapted to retract the lock tongue into the body on rotational movement of the handle.

7. A lock as claimed in claim 6, wherein said means for retaining said tongue comprises a stop member mounted in the body and movable between a first position to retain the lever in engagement with the pin and a second position to free the lever from the pin to enable the lock tongue to be removed from the body.

8. A lock as claimed in claim 6 wherein said projecting means further includes a second pin extending laterally from the opposite side of said tongue, said stop member functioning in a similar manner to retain the lever in engagement with the pin when said tongue has been reversed in position.

* * * * *